US011208317B2

(12) United States Patent
Auffinger et al.

(10) Patent No.: US 11,208,317 B2
(45) Date of Patent: Dec. 28, 2021

(54) FLEXIBLE PACKAGING FOR TEMPERATURE SENSITIVE MATERIALS

(71) Applicant: The Boeing Company, Chicago, IL (US)

(72) Inventors: Caitlin E. Auffinger, Ladson, SC (US); Sean Auffinger, Ladson, SC (US); Katherine L. Frank, Charleston, SC (US); Kevin D. Gordon, Summerville, SC (US); Thomas G. Lawton, Ladson, SC (US); Chunxing She, Summerville, SC (US); Conor J. Van Camp, North Charleston, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/532,373

(22) Filed: Aug. 5, 2019

(65) Prior Publication Data

US 2021/0039944 A1 Feb. 11, 2021

(51) Int. Cl.

| | |
|---|---|
| ***B67D 3/00*** | (2006.01) |
| ***B65D 83/00*** | (2006.01) |
| ***B65D 75/58*** | (2006.01) |

(52) U.S. Cl.

CPC ..... *B67D 3/0067* (2013.01); *B65D 75/5877* (2013.01); *B65D 83/0055* (2013.01); *B67D 3/0022* (2013.01)

(58) Field of Classification Search

CPC ..... B67D 3/0067; B67D 3/0022; B65D 83/0055; B65D 75/5877; B65D 31/147; B65D 77/225

See application file for complete search history.

(56) References Cited

U.S. PATENT DOCUMENTS

| | | | | |
|---|---|---|---|---|
| 3,242,951 | A * | 3/1966 | Curie | B65B 3/045 141/350 |
| 3,268,152 | A * | 8/1966 | Swartz | B65D 31/147 383/45 |
| 4,971,745 | A * | 11/1990 | Ferenc | B29C 45/14336 264/263 |
| 6,302,303 | B1 * | 10/2001 | Reynolds | A61F 5/44 222/146.2 |
| 7,161,120 | B1 * | 1/2007 | Stroud | A45C 13/28 219/386 |
| 2002/0106201 | A1 * | 8/2002 | Tseng | B65D 81/3476 392/339 |

(Continued)

OTHER PUBLICATIONS

PPG Industries, Semco Packaging and Application Systems published Feb. 2011; pp. 1-2.*

(Continued)

*Primary Examiner* — Vishal Pancholi
*Assistant Examiner* — Bob Zadeh
(74) *Attorney, Agent, or Firm* — Haynes and Boone, LLP

(57) ABSTRACT

Systems and methods for a flexible container for transport and storage of a working material are described herein. The material can be a viscous or liquid material when dispensed. The flexible container can be configured to move between a first shape and a second shape. The first shape can allow for efficient transport of the flexible container while the second shape can allow for the flexible container to couple to a dispenser. In certain examples, the flexible container can be cooled for transport and heated for dispensing.

20 Claims, 6 Drawing Sheets

(56) References Cited

U.S. PATENT DOCUMENTS

| | | | | |
|---|---|---|---|---|
| 2002/0148857 | A1* | 10/2002 | Savage | B65D 75/5877 222/107 |
| 2005/0211730 | A1* | 9/2005 | Smith | B65D 77/067 222/185.1 |
| 2006/0001727 | A1* | 1/2006 | Haas | B41J 2/375 347/194 |
| 2009/0198310 | A1* | 8/2009 | Chen | A61F 7/007 607/108 |
| 2015/0237728 | A1* | 8/2015 | Park | H05K 3/429 174/262 |
| 2016/0046427 | A1* | 2/2016 | Bellmore | B65D 75/5877 383/42 |
| 2019/0330585 | A1* | 10/2019 | Vanek | C12M 23/20 |
| 2019/0389635 | A1* | 12/2019 | Kuchinski | B65D 35/12 |

OTHER PUBLICATIONS

3M Science Applied to Life, "3M Polyurethane Adhesive Sealant 551", 4 pages, [online], [retrieved on Jul. 11, 2019]. Retrieved from the Internet: <URL: https://www.3m.com/3M/en_US/company-us/all-3m-products/~/3M-Polyurethane-Adhesive-Sealant-551/?N=5002385+8710954+3292671707&preselect=7569018+8710676+8710815&rt=rud/>.

ASI Adhesives & Sealants Industry, "Sausage Packaging: A Flexible Alternative", 4 pages, [online], [retrieved on Jul. 11, 2019]. Retrieved from the Internet: <URL: https://www.adhesivesmag.com/articles/92173-sausage-packaging-a-flexible-alternative/>.

Grunfeld Fluid, "Barrier Foil for Adhesives and Sealants", 3 pages, [online], [retrieved on Jul. 11, 2019], Retrieved from the Internet: <URL: https://grunfeld-fluid.com/solutions/barrier-foil/>.

* cited by examiner

FLEXIBLE PACKAGING FOR TEMPERATURE SENSITIVE MATERIALS

TECHNICAL FIELD

The disclosure relates generally to materials packaging and, more specifically, to materials packaging for temperature sensitive materials for use with an applicator.

BACKGROUND

Aircrafts use a variety of sealants, adhesives, and other materials during assembly. Such materials can be extruded from applicators. Typically, the materials are packaged in containers or bags and coupled to the applicator. Such containers are typically bags that are generally cylindrical in nature and not very space efficient.

Furthermore, the sealants, adhesives, and other materials can be temperature sensitive. Higher temperatures can accelerate the rate of curing of such sealants, adhesives, and other materials. As such, the materials are typically transported frozen. However, they must be thawed before application. The time to thaw such materials affects throughput of aircraft assembly and fabrication.

SUMMARY

Systems and methods are disclosed for a method for processing a material. The method can include disposing a flexible container between at least two substantially parallel surfaces, coupling a port of the flexible container to a material fill mechanism, providing the material into the flexible container with the material fill mechanism, and freezing the material within the flexible container.

In another example, a flexible container can be disclosed. The flexible container can include a substantially planar container body including a first side and a second side, a port disposed on the container body and configured to receive a nozzle, and a check valve disposed within the port and configured to allow material to flow into the container body and prevent material from flowing out of the container body. The container body is configured to rest in a first position and a second position where container body in the first position is in a substantially planar shape, and where the container body in the second position is in a substantially tubular shape.

The scope of the invention is defined by the claims, which are incorporated into this section by reference. A more complete understanding of the disclosure will be afforded to those skilled in the art, as well as a realization of additional advantages thereof, by a consideration of the following detailed description of one or more implementations. Reference will be made to the appended sheets of drawings that will first be described briefly.

BRIEF DESCRIPTION OF THE DRAWINGS

Examples of the disclosure and their advantages are best understood by referring to the detailed description that follows. It should be appreciated that like reference numerals are used to identify like elements illustrated in one or more of the figures.

DETAILED DESCRIPTION

Various examples of systems and techniques for transporting material are described herein. The systems can include a flexible container. The flexible container can include a substantially planar container body. The container body can include a first side and a second side. The container body can be configured to be stored in either a first position or a second position. In the first position, the container body is a substantially planar shape. In the second position, the container body is a substantially tubular shape. The container body can be of various dimensions and various shapes for a desired implementation and application. For instance, in the first position, the container body can be of various substantially planar shapes, such as a substantially square shape, a substantially rectangular shape, and so forth.

Additionally, the flexible container can include a port disposed on the container body and configured to receive a nozzle and a check valve disposed within the port and configured to allow material to flow into the container body and prevent material from flowing out of the container body.

In another example, a method can be described. The method can include disposing a flexible container between at least two substantially parallel surfaces, coupling a port of the flexible container to a material fill mechanism, providing the material into the flexible container with the material fill mechanism, and freezing the material within the flexible container.

The materials described herein can be processing materials and other viscous or liquid materials, such as aerospace fluids. Such materials can include adhesives, sealants, catalysts, and other such materials used during manufacturing. Certain such materials can have extended shelf lives or processing times if they are transported in certain temperature states such as in an ambient or heated state. The systems and techniques described herein allow for more efficient transport of such materials in a non-ambient state.

In certain examples, the materials can be filled and transported in a first state and dispensed in a second state. The container can be a first shape in the first state and a second shape in the second state. The first shape can improve the speed at which the materials are returned to the second state. The second shape can be configured to interface with an applicator to dispense the materials.

In this regard, a size of the first shape along each dimension of a three-dimensional space may be defined, dependent on implementation and application, to achieve a desired speed at which the materials are returned to the second state and an amount of the materials that can be provided in the container (e.g., the container's capacity). Similarly, a size of the second shape along each dimension of a three-dimensional space may be defined, dependent on implementation and application, to facilitate dispensing of the material.

Figure 1A:
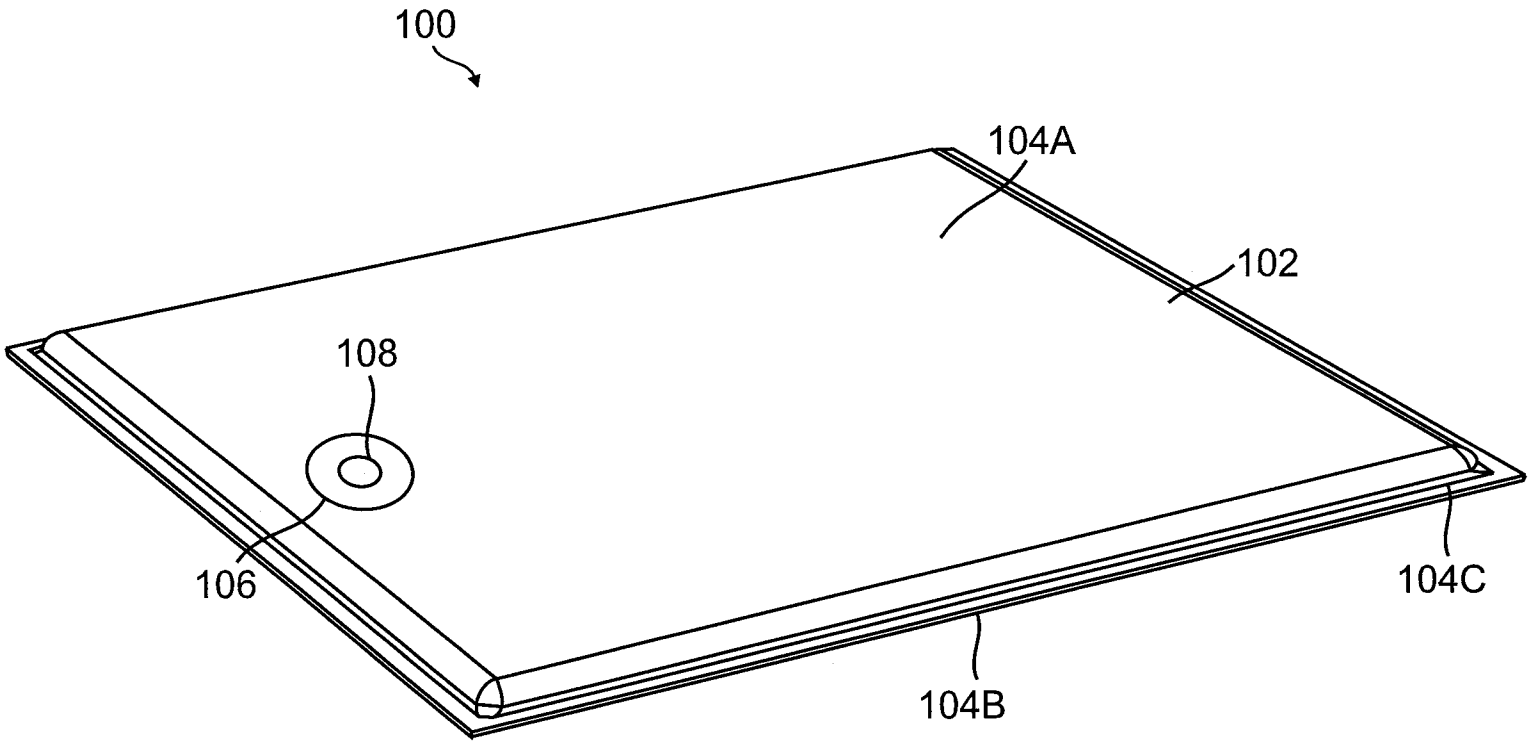
FIGS. 1A and 1B illustrate examples of flexible containers in accordance with examples of the disclosure.
Figure 1B:
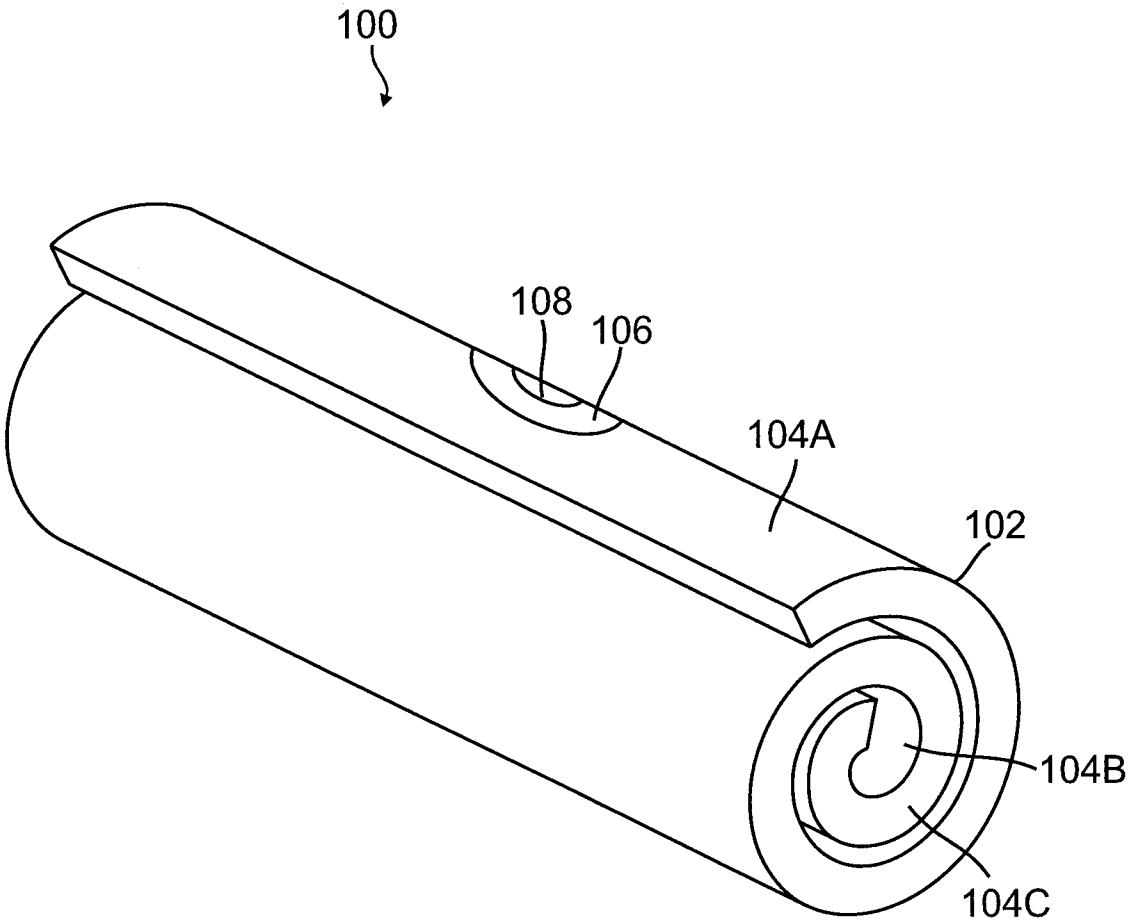

FIGS. 1A and 1B illustrate examples of flexible containers in accordance with examples of the disclosure. FIG. 1A illustrates a flexible container 100 in a first shape. FIG. 1B illustrates flexible container 100 in a second shape.

Flexible container 100 includes a flexible body 102 that includes a first side 104A, a second side 104B, and a middle section 104C. Additionally, a port 106 is disposed on flexible body 102. Port 106 can be configured to receive a nozzle. The nozzle can provide the material to flexible container 100 via port 106.

Port 106 can additionally include a check valve 108. Check valve 108 is disposed within port 106. Check valve 108 can be configured to allow material to flow in a first direction and prevent material from flowing in a second direction. Thus, the check valve 108 can be configured to prevent material from flowing through port 106 when port 106 is not coupled to an additional mechanism such as a nozzle.

First side 104A and second side 104B can be coupled through middle section 104C. First side 104A and second side 104B are each a flexible portion. Such coupling of first side 104A and second side 104B through middle section 104C forms flexible container 100. First side 104A and second side 104B can be substantially flat and planar. Middle section 104C can connect the first side 104A and the second side 104B. In certain examples, first side 104A, second side 104B, and/or middle section 104C can be configured (e.g., pre-tensioned) to position flexible body 102 into the first shape, second shape, or both. Thus, for example, first side 104A, second side 104B, and/or middle section 104C can include pre-tensioned elastic bands that will move flexible body 102 from the first shape to the second shape when a force greater than a threshold force (e.g., a force rolling up flexible body 102) is received. In certain examples, another one of first side 104A, second side 104B, and/or middle section 104C can be configured to move flexible body 102 from the second shape to the first shape when a force greater than a threshold force, whether of the same magnitude or a different magnitude, is received.

In certain examples, flexible body 102 is configured to be disposed in a plurality of different configurations. For example, flexible body 102 can be disposed in a substantially planar first shape as shown in FIG. 1A and a substantially cylindrical second shape as shown in FIG. 1B. The first shape can be a substantially planar shape. As such, flexible body 102 is substantially flat when in the first shape (e.g., first side 104A and second side 104B can be within 10% of parallel). The flexible body 102 can be of various dimensions and various shapes (e.g., substantially square, substantially rectangular, etc. in the first shape) for a desired implementation and application.

Current techniques typically transport materials within sausage tubes or other cylindrical containers. Transport within such tubes or cylindrical containers can often be inefficient as there are open space between the objects. Meanwhile, the flexible container 100 (e.g., substantially planar or flat flexible container) can be stacked. Thus, for example, a plurality of flexible containers 100 can be stacked on top of each other. Such stacking allows for simplified transport and handling of a shipment of flexible containers 100.

Additionally, current tubes or cylindrical containers have a poor volume to surface area ratio (e.g., the ratio can be high as the volume is much greater than the surface area). Such a poor ratio can increase heating and cooling times. Thus, for example, a tube or cylindrical container can be filled with a fluid at a first temperature, stored at a second temperature, but dispensed at a third temperature. The poor ratio can lead to longer transition times between the first temperature, the second temperature, and the third temperature. The longer times can negatively affect throughput.

By contrast, the flexible container 100 has a better (e.g., lower) volume to surface area ratio due to flexible container 100 having a larger exposed surface area. Such an improved volume to surface area ratio can decrease the amount of time required to transition between the first temperature, the second temperature, and the third temperature. Additionally, the substantially planar first shape of flexible container 100 can allow for simplified placement of flexible container 100 on a heating or cooling pad or other surface, further decreasing heating or cooling times.

Furthermore, flexible container 100 can be configured to interface with existing applicators. As such, in the second shape, flexible container 100 can be rolled into a substantially cylindrical shape. Flexible container 100 in the substantially cylindrical shape can be coupled to existing applicators configured to receive substantially cylindrical containers. Thus, for example, flexible container 100 can couple to a nozzle or other receiver of an applicator through port 106 or through a puncture created by a user or the applicator.

While in the substantially cylindrical shape, flexible container 100 can still include an improved volume to surface area ratio as compared to conventional containers. Thus, even in the second shape, flexible container 100 can be heated or cooled quicker than conventional containers.

Figure 2:
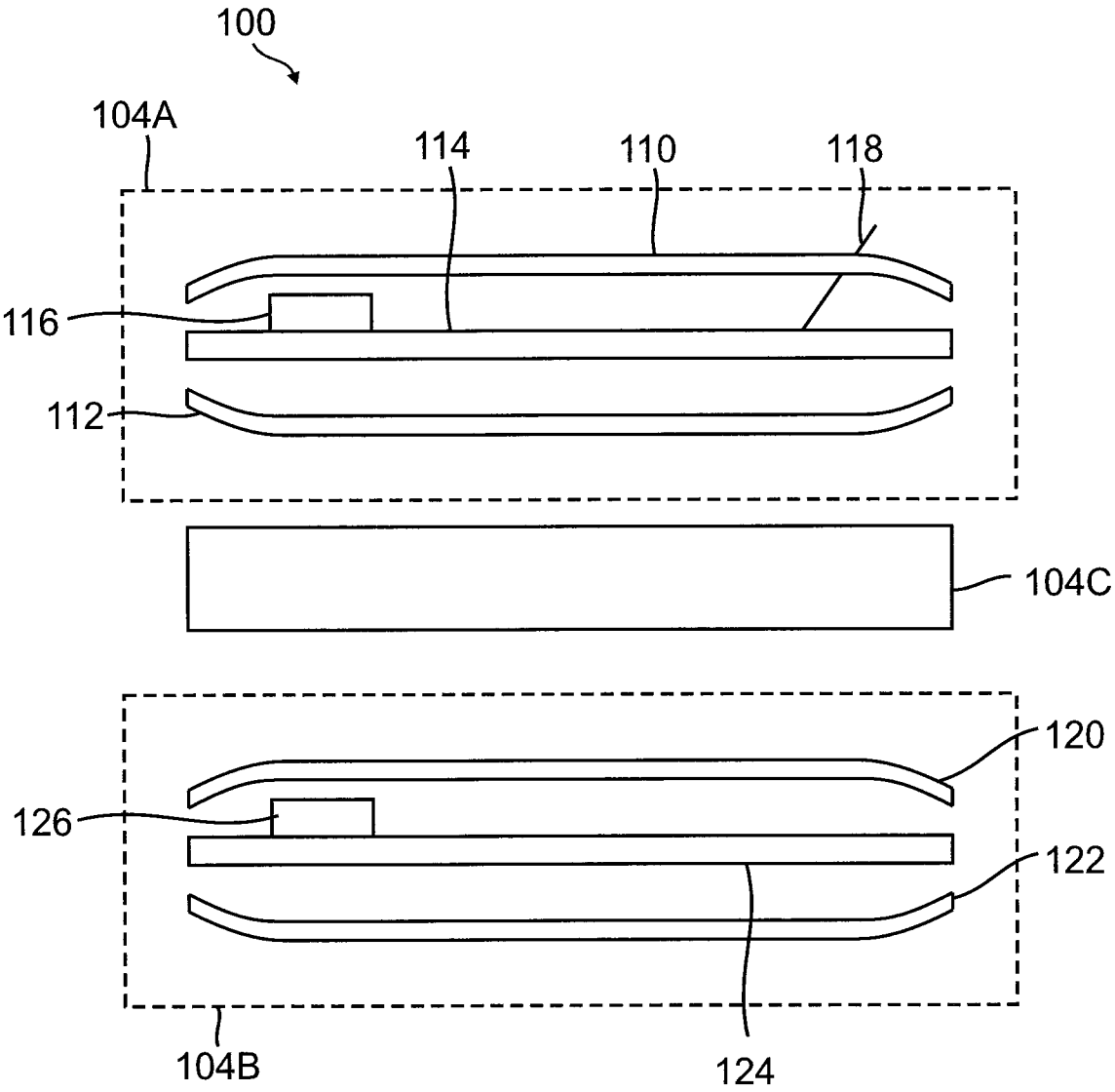
FIG. 2 illustrates an exploded side view of a flexible container in accordance with an example of the disclosure.

FIG. 2 illustrates an exploded side view of a flexible container in accordance with an example of the disclosure. FIG. 2 illustrates an exploded view of flexible container 100 that includes first side 104A, second side 104B, and/or middle section 104C as shown in FIGS. 1A and 1B. FIG. 2 shows an example of flexible container 100 that can be configured to provide self heating and/or cooling.

As shown in FIG. 2, first side 104A includes a top side 110 (e.g., an outer layer), a bottom side 112 (e.g., an inner layer), temperature control elements 114 (e.g., thermal elements), controller 116, and electrical coupling 118 (e.g., power connection). Second side 104B includes top side 120, bottom side 122, temperature control elements 124, and controller 126. As such, both first side 104A and second side 104E can be configured to provide heating or cooling to flexible container 100 and, thus, the material disposed within flexible container 100. In certain examples, the material can be disposed between first side 104A and second side 104B within, for example, middle section 104C.

Temperature control element 114 (e.g., thermal element) is disposed between top side 110 (e.g., outer layer) and bottom side 112 (e.g., inner layer). Temperature control element 124 (e.g., thermal element) is disposed between top side 120 and bottom side 122. Thus, temperature control elements 114 and 124 can be disposed within a cavity defined by top sides 110 and 120, respectively, on one side and by bottom sides 112 and 122, respectively, on another side.

One or more of top sides 110 and 120 and bottom sides 112 and 122 can be made of a material that can conduct heat. In one example, a thermal conductivity of bottom side 112 is greater than a thermal conductivity of top side 110, or vice versa. Thus, the heating and/or cooling of temperature control elements 114 and/or 124 can be conducted by top sides 110 and 120 and bottom sides 112 and 122 to the materials contained within flexible container 100. In this regard, the temperature control elements 114 and/or 124 may be operated when one container body is in contact with another container body. The temperature control elements 114 and/or 124 may be operated in response to conduction between the container bodies due to the contact.

Temperature control elements 114 and 124 are powered by electrical coupling 118 (e.g., power connection). Electrical coupling 118 can be a wired or wireless connection configured to receive power from an external source. In certain examples, temperature control elements 114 and 124 can each have their own electrical couplings, but the example shown in FIG. 2 illustrates a shared electrical coupling 118 for both temperature control elements 114 and 124.

Operation of temperature control elements 114/124 can be controlled by controllers 116/126, respectively. Controller 116/126 can include, for example, a microprocessor, a microcontroller, a signal processing device, a memory storage device, and/or any additional devices to perform any of the various operations described herein. In various examples, controllers 116/126 and/or its associated operations can be implemented as a single device or multiple connected devices to collectively constitute controllers 116/126.

Controllers 116/126 can include one or more memory components or devices to store data and information. The memory can include volatile and non-volatile memory. Examples of such memory include RAM (Random Access Memory), ROM (Read-Only Memory), EEPROM (Electrically-Erasable Read-Only Memory), flash memory, or other types of memory. In certain examples, controllers 116/126 can be adapted to execute instructions stored within the memory to perform various methods and processes described herein, including implementation and execution of control algorithms responsive to heating or cooling of the materials scored by flexible container 100.

In various examples, controllers 116/126 can cause temperature control elements 114/124 to increase or decrease in temperature (and, thus, provide heating or cooling to the material contained within flexible container 100). Such increase or decrease in temperature can be in response to a user input (e.g., an input received through a pressing of a button), through a position of flexible container 100 sensed by temperature control elements 114/124 (e.g., when flexible container 100 is in the second shape, temperature control elements 114/124 can provide cooling while when flexible container 100 is in the first shape, temperature control elements 114/124 can provide heating), through detection of a nozzle inserted into port 106, or through another such condition causing operation of temperature control elements 114/124.

Figure 3:
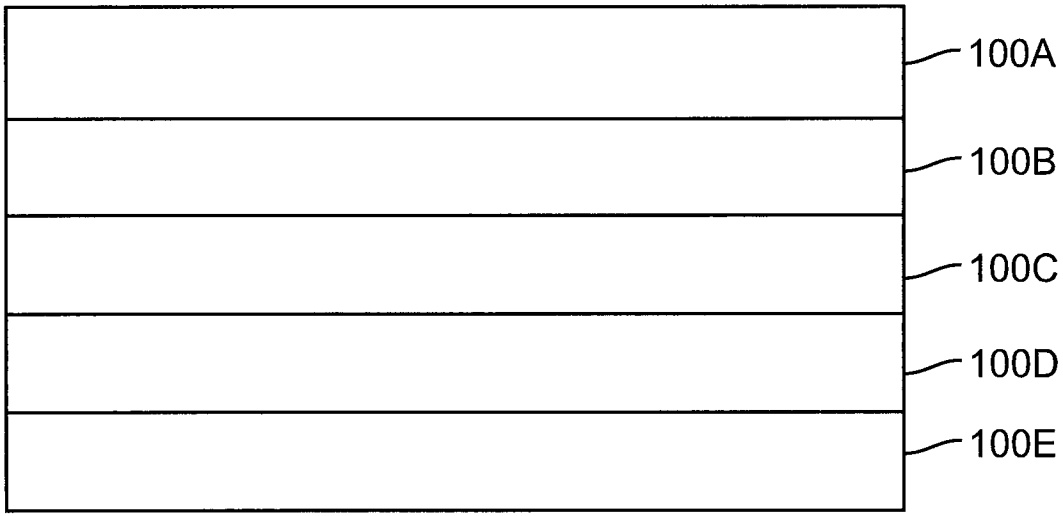
FIG. 3 illustrates a side view of a stack of flexible containers in accordance with an example of the disclosure.

FIG. 3 illustrates a side view of a stack of flexible containers in accordance with an example of the disclosure. As shown in FIG. 3, five flexible containers 100A-E are each disposed in the first shape. Thus, flexible containers 100A-E are flat. Flexible containers 100A-E in the first shape are stacked on top of each other. Such a configuration allows for more space efficient packing and shipping of flexible containers 100A-E.

Figure 4:
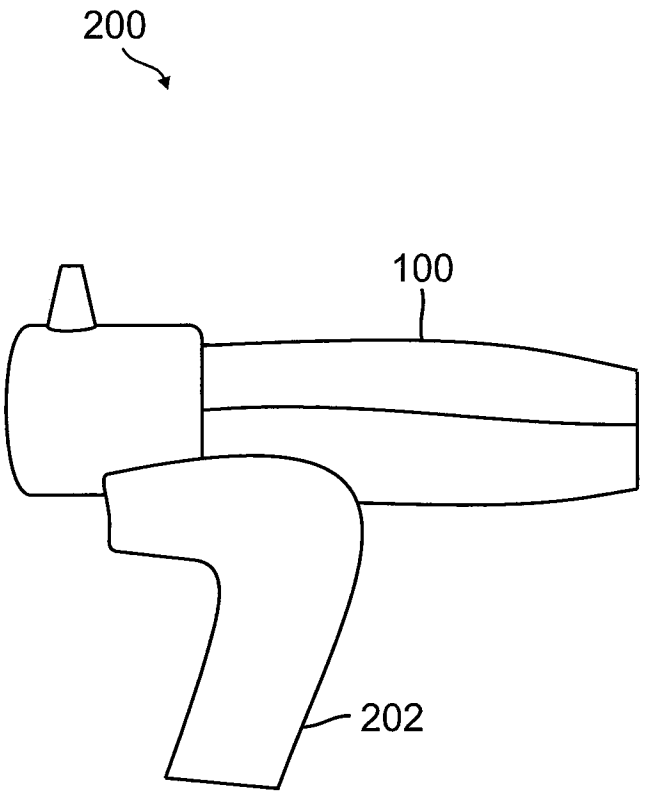
FIG. 4 illustrates a side view of an applicator in accordance with an example of the disclosure.

FIG. 4 illustrates a side view of an applicator in accordance with an example of the disclosure. FIG. 4 illustrates a material applicator system 200 that includes flexible container 100 and applicator 202. Applicator 202 can be any applicator configured to dispense the material. Thus, in certain examples, applicator 202 can be an applicator gun configured to receive the material from flexible container 100. Applicator 202 can thus be, for example, a dispenser such as a 3M 600A or Semco 250-A applicator gun.

Applicator 202 can include an inlet configured to couple with port 106 of flexible container 100. Port 106 can thus receive an inlet of applicator 202, such as a hose, for applicator 202 to dispense the material within flexible container 100.

Figure 5:
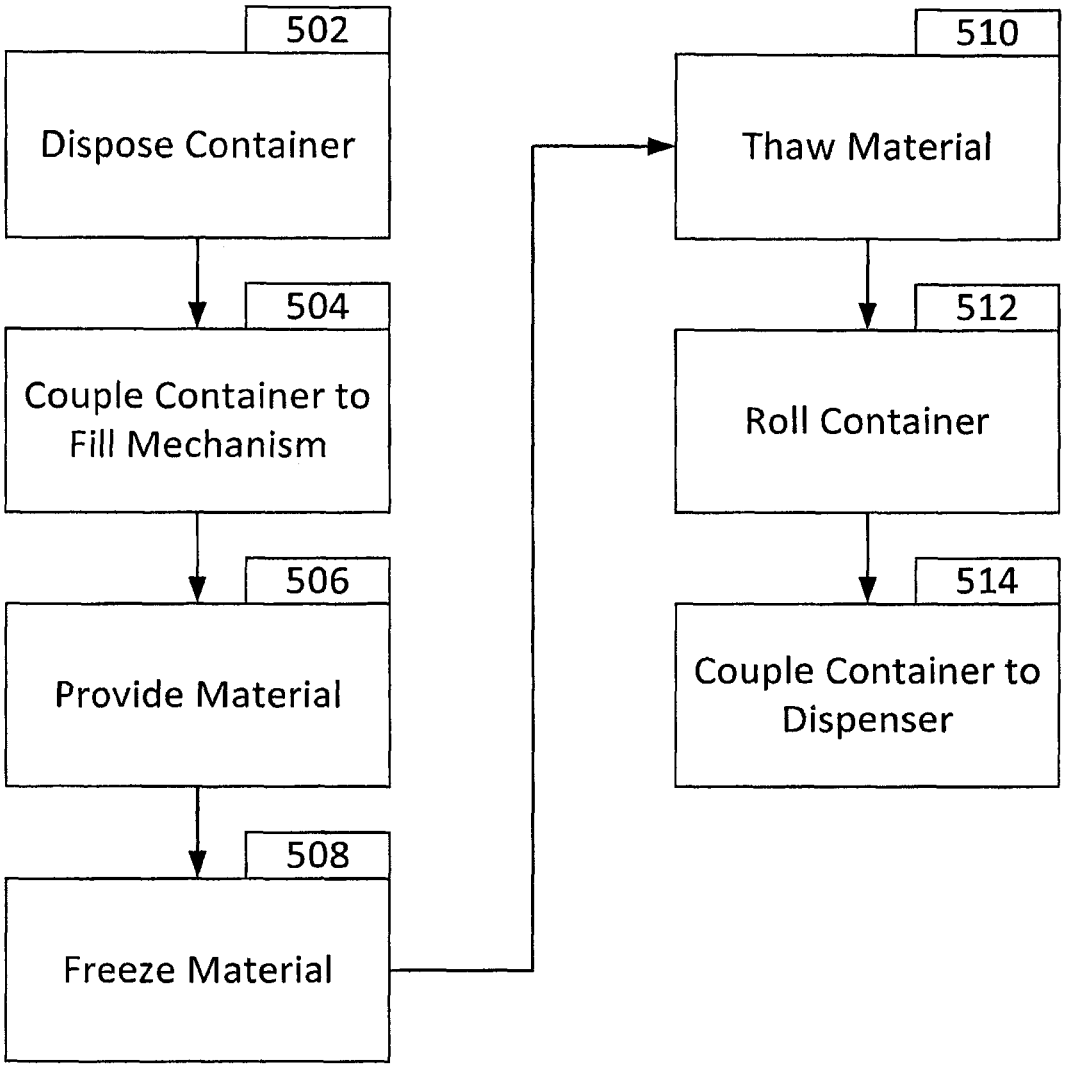
FIG. 5 is a flowchart detailing a technique for transporting and applying the material in accordance with an example of the disclosure.

FIG. 5 is a flowchart detailing a technique for transporting and applying the material in accordance with an example of the disclosure. In block 502, a flexible container is disposed on a fill surface or within an area that would allow for the flexible container to be filled. In certain examples, the flexible container can be disposed between two substantially parallel surfaces so that, when the flexible container is filled with the material, the flexible container is in the first shape.

In block 504, the flexible container can be coupled to a fill mechanism. Thus, the port of the flexible container can receive a nozzle or another fill mechanism. The flexible container can then be filled with the material (e.g., through the fill mechanism) in block 506.

After being filled with the material, the material within the flexible container can be cooled or frozen in block 508. The material can be cooled or frozen by placing the flexible container within a cooler (e.g., a freezer) or by causing (e.g., by providing power to) temperature control elements of the flexible container to provide cooling. In certain examples, the surface that the flexible container is disposed on can be heated and/or cooled during or after the material has been provided to the flexible container. As such, the material within the flexible container can be cooled for transport. The material can then accordingly be stacked and transported.

After the material has been transported and has arrived at its destination, the material can then be thawed and brought to a temperature appropriate for dispensing in block 510. Thus, the material can be heated by placing the flexible container within a heated area, within an ambient temperature area, on a heated surface, or by causing (e.g., by providing power to) temperature control elements of the flexible container to provide heating.

The flexible container can then be rolled or otherwise moved into an appropriate shape in block 512. After the flexible container has been rolled or moved into the appropriate shape, the flexible container can be coupled to the dispenser in block 514. Thus, a port of the flexible container can be coupled to a nozzle of the dispenser. The material can then flow into the dispenser to be extruded onto a surface.

Examples described above illustrate but do not limit the invention. It should also be understood that numerous modifications and variations are possible in accordance with the principles of the present invention. Accordingly, the scope of the invention is defined only by the following claims.

What is claimed is:

1. A flexible container comprising:

a substantially planar container body comprising a first side and a second side, wherein the container body is configured to rest in a first position and a second position, wherein the container body in the first position is in a substantially planar shape, and wherein the container body in the second position is in a substantially tubular shape;

a thermal element disposed in the container body;

a port disposed at the first side of the container body and substantially centered across a width of the container body such that the port is configured to receive a nozzle; and a check valve disposed within the port and configured to allow material to flow into the container body and prevent the material from flowing out of the container body, wherein:

the port and check valve are flush with the first side to allow planar stacking of the container body in the first position, and the thermal element is configured to be operated when the container body is in contact with another container body.

2. A method for processing a material, the method comprising:

disposing the flexible container of claim 1 between at least two substantially parallel surfaces;

coupling the port of the flexible container to a material fill mechanism;

providing the material into the flexible container with the material fill mechanism; and freezing the material within the flexible container.

3. The method of claim 2, further comprising:

thawing the material;

rolling the flexible container into the substantially tubular shape; and coupling the flexible container to a dispenser.

4. The method of claim 3, wherein the flexible container is configured to fully roll into the substantially tubular shape upon receiving a first force.

5. The method of claim 3, wherein the coupling the flexible container to the dispenser comprises puncturing the flexible container with the dispenser.

6. The method of claim 3, wherein the coupling the flexible container to the dispenser comprises receiving the nozzle of the dispenser with the check valve of the flexible container.

7. The method of claim 3, further comprising:

flowing the material into the dispenser; and extruding the material onto a first surface with the dispenser.

8. The method of claim 3, wherein the freezing the material and the thawing the material are through operation of the thermal element within the flexible container, wherein method further comprises operating the thermal element when the flexible container is in contact with another flexible container.

9. The method of claim 3, wherein the dispenser is a 3M 600A or Semco 250-A applicator gun.

10. The method of claim 2, wherein the material is an aerospace fluid.

11. The method of claim 2, further comprising:

coupling the first side comprising a first flexible portion and the second side comprising a second flexible portion to form the flexible container.

12. The flexible container of claim 1, wherein the material is an aerospace fluid.

13. The flexible container of claim 12, wherein the first side is tensioned when the container body is in the first position.

14. The flexible container of claim 1, wherein the port is configured to couple to an inlet of a dispenser.

15. The flexible container of claim 14, wherein the dispenser is a 3M 600A or Semco 250-A applicator gun.

16. The flexible container of claim 1, wherein the thermal element is operated in response to conduction between the container bodies due to the contact.

17. A flexible container comprising:

a substantially planar container body comprising a first side and a second side, wherein the container body is configured to rest in a first position and a second position, wherein the container body in the first position is in a substantially planar shape, and wherein the container body in the second position is in a substantially tubular shape;

a port disposed on the container body and configured to receive a nozzle;

a check valve disposed within the port and configured to allow material to flow into the container body and prevent the material from flowing out of the container body, wherein the port and check valve are flush with the container body to allow planar stacking of the container body in the first position;

a thermal element disposed in the container body, wherein the thermal element is configured to be operated when the container body is in contact with another container body; and a controller configured to control a temperature of the thermal element, disposed on the thermal element.

18. The flexible container of claim 17, wherein the thermal element is operated in response to conduction between the container bodies due to the contact.

19. The flexible container of claim 17, wherein the first side comprises an outer layer and an inner layer, and wherein the thermal element is disposed between the outer layer and the inner layer.

20. The flexible container of claim 19, wherein a thermal conductivity of the inner layer is greater than a thermal conductivity of the outer layer.

* * * * *